US010276941B2

(12) United States Patent
Bauder

(10) Patent No.: US 10,276,941 B2
(45) Date of Patent: Apr. 30, 2019

(54) MULTIPLE-INPUT MULTIPLE-OUTPUT RF ANTENNA ARCHITECTURES

(71) Applicant: RF Micro Devices, Inc., Greensboro, NC (US)

(72) Inventor: Ruediger Bauder, Feldkirchen-Westerham (DE)

(73) Assignee: Qorvo US, Inc., Greensboro, NC (US)

( * ) Notice: Subject to any disclaimer, the term of this patent is extended or adjusted under 35 U.S.C. 154(b) by 92 days.

(21) Appl. No.: 14/600,977

(22) Filed: Jan. 20, 2015

(65) Prior Publication Data

US 2015/0207238 A1 Jul. 23, 2015

Related U.S. Application Data

(60) Provisional application No. 61/929,172, filed on Jan. 20, 2014.

(51) Int. Cl.

| | |
|---|---|
| ***H01Q 21/00*** | (2006.01) |
| ***H01Q 21/24*** | (2006.01) |
| ***H01Q 9/42*** | (2006.01) |
| ***H01Q 21/28*** | (2006.01) |

(52) U.S. Cl.
CPC ..... *H01Q 9/42* (2013.01); *H01Q 21/24* (2013.01); *H01Q 21/28* (2013.01)

(58) Field of Classification Search
CPC ..... H01Q 21/24; H01Q 21/28; H01Q 9/42; H01Q 21/00; H01Q 21/0006
USPC ..... 343/700 MS, 702, 725, 727, 846, 853, 343/893
See application file for complete search history.

(56) References Cited

U.S. PATENT DOCUMENTS

| | | | | |
|---|---|---|---|---|
| 4,198,639 A * | 4/1980 | Killion | H01Q 11/10 | 343/727 |
| 4,334,230 A * | 6/1982 | Kane | H01Q 3/44 | 342/371 |
| 6,480,167 B2 * | 11/2002 | Matthews | H01Q 3/40 | 343/795 |
| 7,880,683 B2 * | 2/2011 | Shtrom | H01Q 9/285 | 343/795 |
| 8,077,106 B2 * | 12/2011 | Sato | H01Q 1/3241 | 343/787 |
| 8,164,525 B2 * | 4/2012 | Park | H01Q 1/2266 | 343/700 MS |
| 8,217,850 B1 * | 7/2012 | Jennings | H01Q 3/26 | 343/722 |

* cited by examiner

*Primary Examiner* — Tho G Phan
(74) *Attorney, Agent, or Firm* — Withrow & Terranova, P.L.L.C.

(57) ABSTRACT

RF communications circuitry, which includes a first RF antenna element, a second RF antenna element, a third RF antenna element, and a fourth RF antenna element is disclosed. The first RF antenna element is proximal to the second RF antenna element. The third RF antenna element is proximal to the fourth RF antenna element. A primary axis of the first RF antenna element is about perpendicular to a primary axis of one of the third RF antenna element and the fourth RF antenna element.

23 Claims, 9 Drawing Sheets

MULTIPLE-INPUT MULTIPLE-OUTPUT RF ANTENNA ARCHITECTURES

RELATED APPLICATIONS

This application claims the benefit of U.S. provisional patent application No. 61/929,172, filed Jan. 20, 2014, the disclosure of which is incorporated herein by reference in its entirety.

FIELD OF THE DISCLOSURE

Embodiments of the present disclosure relate to radio frequency (RF) communications systems, which may include RF front-end circuitry, RF transceiver circuitry, RF transmit circuitry, RF receive circuitry, RF diplexers, RF duplexers, RF filters, RF antennas, RF switches, RF combiners, RF splitters, the like, or any combination thereof.

BACKGROUND

As wireless communications technologies evolve, wireless communications systems become increasingly sophisticated. As such, wireless communications protocols continue to expand and change to take advantage of the technological evolution. As a result, to maximize flexibility, many wireless communications devices must be capable of supporting any number of wireless communications protocols, each of which may have certain performance requirements, such as specific out-of-band emissions requirements, linearity requirements, or the like. Further, portable wireless communications devices are typically battery powered and need to be relatively small, and have low cost. As such, to minimize size, cost, and power consumption, RF circuitry in such a device needs to be as simple, small, flexible, and efficient as is practical. Thus, there is a need for RF circuitry in a communications device that is low cost, small, simple, flexible, and efficient.

SUMMARY

RF communications circuitry, which includes a first RF antenna element, a second RF antenna element, a third RF antenna element, and a fourth RF antenna element is disclosed. The first RF antenna element is proximal to the second RF antenna element. The third RF antenna element is proximal to the fourth RF antenna element. A primary axis of the first RF antenna element is about perpendicular to a primary axis of one of the third RF antenna element and the fourth RF antenna element.

Different embodiments of the RF communications circuitry may relate to different multiple-input multiple-output (MIMO) RF antenna architectures. In one embodiment of the RF communications circuitry, diversity RF antennas are used to augment primary RF antennas. The diversity RF antennas may improve performance of the RF communications circuitry during high voltage standing wave ratio (VSWR) conditions. In one embodiment of the RF communications circuitry, both highband RF antennas and lowband RF antennas are used to implement carrier aggregation (CA). Splitting CA into two separate bands may provide improved performance during simultaneous RF transmissions, RF receptions, or both.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

Figure 1:
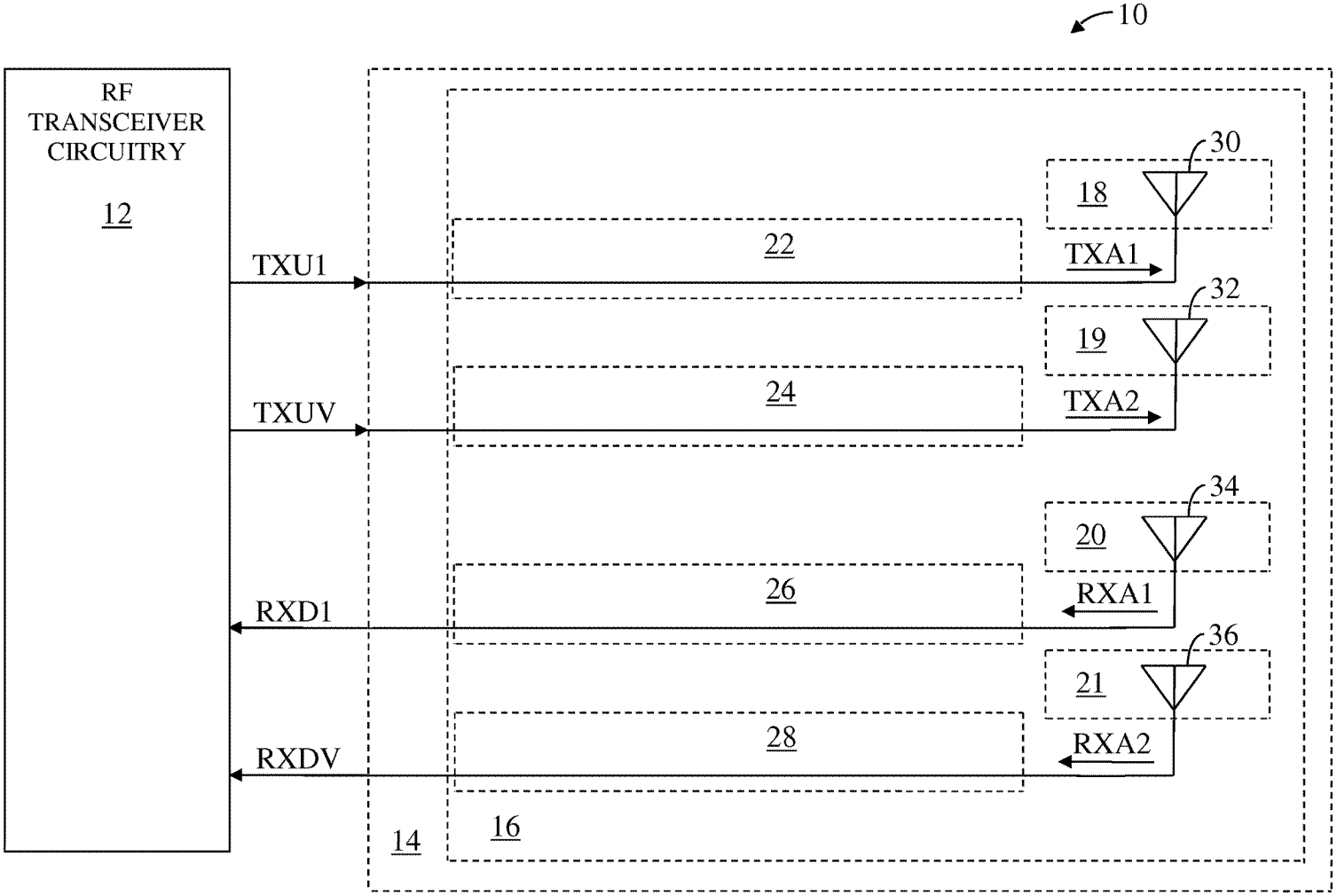
FIG. 1 shows RF communications circuitry according to one embodiment of the RF communications circuitry.

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

It will be understood that when an element such as a layer, region, or substrate is referred to as being "over," "on," "in," or extending "onto" another element, it can be directly over, directly on, directly in, or extend directly onto the other element or intervening elements may also be present. In contrast, when an element is referred to as being "directly over," "directly on," "directly in," or extending "directly onto" another element, there are no intervening elements present. It will also be understood that when an element is referred to as being "coupled" to another element, it can be directly coupled to the other element or intervening elements may be present. In contrast, when an element is referred to as being "directly coupled" to another element, there are no intervening elements present. It will also be understood that when an element is referred to as being "connected" to another element, it can be directly connected to the other element or intervening conductive elements may be present. In contrast, when an element is referred to as being "directly connected" to another element, there are no intervening conductive elements present.

The term "thermally connected" is defined herein and for any claims that follow to require a coupling wherein the thermal conductivity of the coupling is greater than or equal to about 10 British thermal units per hour-degree Fahrenheit-foot. The term "electrically connected" is defined herein and for any claims that follow to require a coupling wherein the electrical resistivity is less than or equal to about $25\times10^{-8}$ ohm-meters. Any intervening conductive elements would have an electrical resistivity of less than or equal to about $25\times10^{-8}$ ohm-meters. Any intervening conductive elements would have a thermal conductivity of greater than or equal to about 10 British thermal units per hour-degree Fahrenheit-foot.

The term "proximal" is defined herein and for any claims that follow to mean "closely located." In a first example, a first device is proximal to a second device if the first device is located close to the second device. In a second example, the first device is proximal to the second device if a separation between the first device and the second device is less than a length of either the first device or the second device. In a third example, the first device is proximal to the second device if the first device overlaps the second device. In a fourth example, the first device is proximal to the second device if the first device and the second device share at least one via hole.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

RF communications circuitry, which includes a first RF antenna element, a second RF antenna element, a third RF antenna element, and a fourth RF antenna element is disclosed. The first RF antenna element is proximal to the second RF antenna element. The third RF antenna element is proximal to the fourth RF antenna element. A primary axis of the first RF antenna element is about perpendicular to a primary axis of one of the third RF antenna element and the fourth RF antenna element.

Different embodiments of the RF communications circuitry may relate to different multiple-input multiple-output (MIMO) RF antenna architectures. In one embodiment of the RF communications circuitry, diversity RF antennas are used to augment primary RF antennas. The diversity RF antennas may improve performance of the RF communications circuitry during high voltage standing wave ratio (VSWR) conditions. In one embodiment of the RF communications circuitry, both highband RF antennas and lowband RF antennas are used to implement carrier aggregation (CA). Splitting CA into two separate bands may provide improved performance during simultaneous RF transmissions, RF receptions, or both.

FIG. 1 shows RF communications circuitry 10 according to one embodiment of the RF communications circuitry 10. The RF communications circuitry 10 includes RF transceiver circuitry 12 and RF front-end circuitry 14. The RF front-end circuitry 14 includes an RF antenna structure 16. The RF antenna structure 16 includes a first RF antenna element 18, a second RF antenna element 19, a third RF antenna element 20, a fourth RF antenna element 21, a first RF transmission line 22, a second RF transmission line 24, a third RF transmission line 26, and a fourth RF transmission line 28.

The first RF antenna element 18 includes a first RF transmit antenna element 30 and the second RF antenna element 19 includes a second RF transmit antenna element 32. The third RF antenna element 20 includes a first RF receive antenna element 34 and the fourth RF antenna element 21 includes a second RF receive antenna element 36. In one embodiment of the first RF antenna element 18 and the second RF antenna element 19, the first RF transmit antenna element 30 is a primary transmit antenna element and the second RF transmit antenna element 32 is a diversity transmit antenna element.

In this regard, the RF transceiver circuitry 12 provides a first upstream RF transmit signal TXU1 to the first RF transmission line 22, which forwards the first upstream RF transmit signal TXU1 to provide a first RF antenna transmit signal TXA1 to the first RF transmit antenna element 30, which transmits the first RF antenna transmit signal TXA1. In general, the first RF antenna element 18 transmits the first RF antenna transmit signal TXA1. Similarly, the RF transceiver circuitry 12 provides a diversity upstream RF transmit signal TXUV to the second RF transmission line 24, which forwards the diversity upstream RF transmit signal TXUV to provide a second RF antenna transmit signal TXA2 to the second RF transmit antenna element 32, which transmits the second RF antenna transmit signal TXA2. In general, the second RF antenna element 19 transmits the second RF antenna transmit signal TXA2.

By transmitting the first RF antenna transmit signal TXA1, the second RF antenna transmit signal TXA2, or both simultaneously, the RF communications circuitry 10 may be able to at least partially compensate for high VSWR conditions at the first RF transmit antenna element 30, at the second RF transmit antenna element 32, or both.

Similarly, in one embodiment of the third RF antenna element 20 and the fourth RF antenna element 21, the first RF receive antenna element 34 is a primary receiving antenna element and the second RF receive antenna element 36 is a diversity receiving antenna element.

In this regard, the first RF receive antenna element 34 receives and provides a first RF antenna receive signal RXA1 to the third RF transmission line 26, which forwards the first RF antenna receive signal RXA1 to provide a first downstream RF receive signal RXD1 to the RF transceiver circuitry 12. In general, the third RF antenna element 20 receives the first RF antenna receive signal RXA1. Similarly, the second RF receive antenna element 36 receives and provides a second RF antenna receive signal RXA2 to the fourth RF transmission line 28, which forwards the second RF antenna receive signal RXA2 to provide a diversity downstream RF receive signal RXDV to the RF transceiver circuitry 12. In general, the fourth RF antenna element 21 receives the second RF antenna receive signal RXA2.

By receiving the first RF antenna receive signal RXA1, the second RF antenna receive signal RXA2, or both simultaneously, the RF communications circuitry 10 may be able to at least partially compensate for high VSWR conditions at the first RF receive antenna element 34, at the second RF receive antenna element 36, or both.

In one embodiment of the first RF antenna element 18 and the second RF antenna element 19, the first RF antenna element 18 is proximal to the second RF antenna element 19. As such, in one embodiment of the first RF antenna element 18 and the second RF antenna element 19, the first RF antenna element 18 overlaps the second RF antenna element 19. In one embodiment of the first RF antenna element 18 and the second RF antenna element 19, the first RF antenna element 18 is directly connected to the second RF antenna element 19. In one embodiment of the first RF antenna element 18 and the second RF antenna element 19, there is a separation 54 (FIG. 8) between the first RF antenna element 18 and the second RF antenna element 19. In one embodiment of the first RF antenna element 18 and the second RF antenna element 19, the separation 54 (FIG. 8) is less than an antenna length 64 (FIG. 9B) of the first RF antenna element 18. As such, in one embodiment of the first RF antenna element 18 and the second RF antenna element 19, the first RF antenna element 18 is not directly connected to the second RF antenna element 19.

In one embodiment of the third RF antenna element 20 and the fourth RF antenna element 21, the third RF antenna element 20 is proximal to the fourth RF antenna element 21. As such, in one embodiment of the third RF antenna element 20 and the fourth RF antenna element 21, the third RF antenna element 20 overlaps the fourth RF antenna element 21. In one embodiment of the third RF antenna element 20 and the fourth RF antenna element 21, the third RF antenna element 20 is directly connected to the fourth RF antenna element 21.

In one embodiment of the third RF antenna element 20 and the fourth RF antenna element 21, there is a separation 54 (FIG. 8) between the third RF antenna element 20 and the fourth RF antenna element 21, such that the separation 54 (FIG. 8) is less than an antenna length 64 (FIG. 9B) of the third RF antenna element 20. As such, in one embodiment of the third RF antenna element 20 and the fourth RF antenna element 21, the third RF antenna element 20 is not directly connected to the fourth RF antenna element 21. In an alternate embodiment of the RF communications circuitry 10, any or all of the first RF transmission line 22, the second RF transmission line 24, the third RF transmission line 26, and the fourth RF transmission line 28 are omitted.

Figure 2:
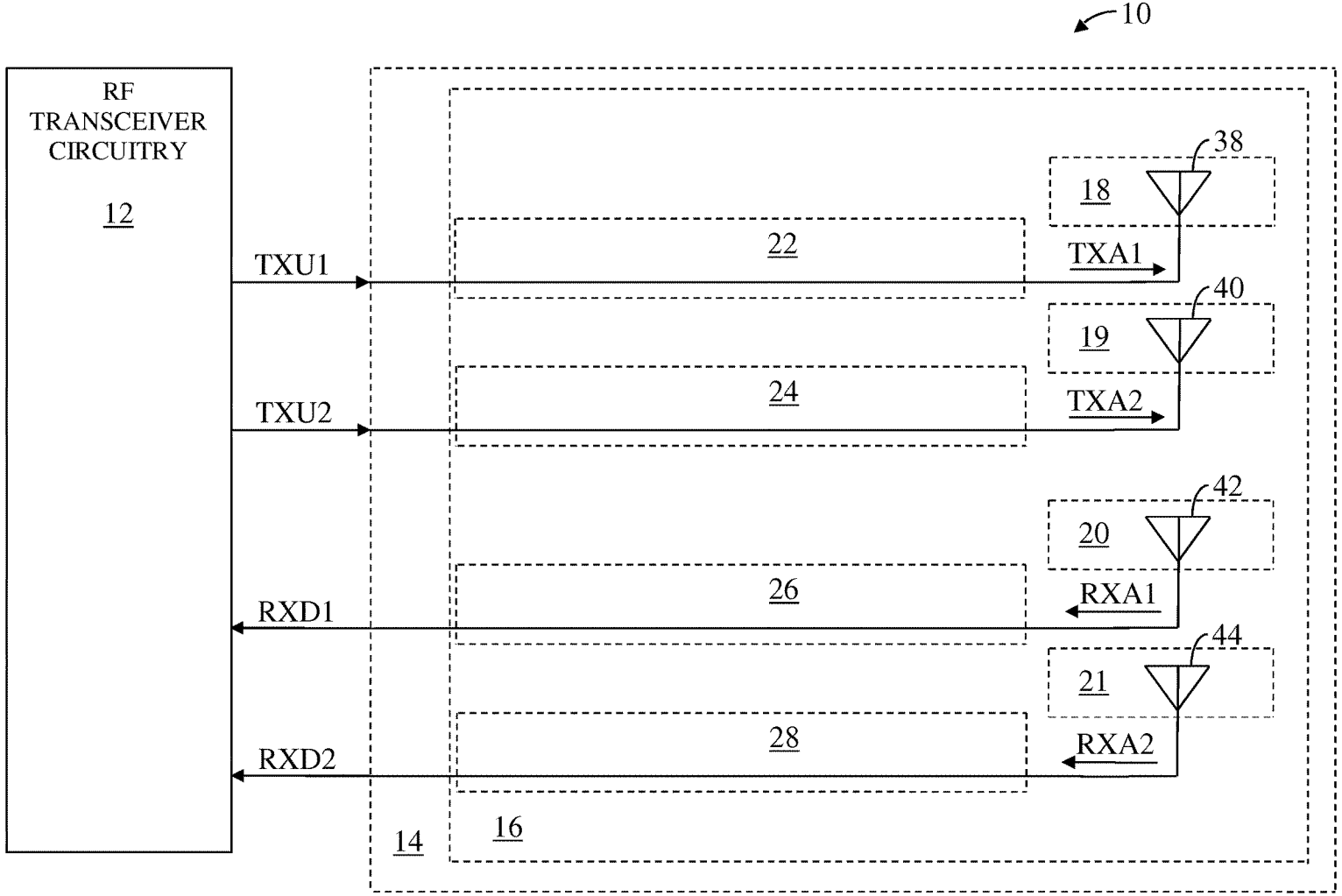
FIG. 2 shows RF communications circuitry according to an alternate embodiment of the RF communications circuitry.

FIG. 2 shows RF communications circuitry 10 according to an alternate embodiment of the RF communications circuitry 10. The RF communications circuitry 10 illustrated in FIG. 2 is similar to the RF communications circuitry 10 illustrated in FIG. 1, except in the RF communications circuitry 10 illustrated in FIG. 2, the first RF antenna element 18 includes a first lowband RF antenna element 38 and the second RF antenna element 19 includes a first highband RF antenna element 40. The third RF antenna element 20 includes a second lowband RF antenna element 42 and the fourth RF antenna element 21 includes a second highband RF antenna element 44.

In this regard, the RF transceiver circuitry 12 provides the first upstream RF transmit signal TXU1 to the first RF transmission line 22, which forwards the first upstream RF transmit signal TXU1 to provide the first RF antenna transmit signal TXA1 to the first lowband RF antenna element 38, which transmits the first RF antenna transmit signal TXA1. Similarly, the RF transceiver circuitry 12 provides a second upstream RF transmit signal TXU2 to the second RF transmission line 24, which forwards the second upstream RF transmit signal TXU2 to provide the second RF antenna transmit signal TXA2 to the first highband RF antenna element 40, which transmits the second RF antenna transmit signal TXA2.

The second lowband RF antenna element 42 receives and provides the first RF antenna receive signal RXA1 to the third RF transmission line 26, which forwards the first RF antenna receive signal RXA1 to provide the first downstream RF receive signal RXD1 to the RF transceiver circuitry 12. Similarly, the second highband RF antenna element 44 receives and provides the second RF antenna receive signal RXA2 to the fourth RF transmission line 28, which forwards the second RF antenna receive signal RXA2 to provide a second downstream RF receive signal RXD2 to the RF transceiver circuitry 12.

In one embodiment of the first RF antenna element 18 and the second RF antenna element 19, the first lowband RF antenna element 38 is proximal to the first highband RF antenna element 40. As such, in one embodiment of the first RF antenna element 18 and the second RF antenna element 19, the first lowband RF antenna element 38 overlaps the first highband RF antenna element 40. In one embodiment of the first RF antenna element 18 and the second RF antenna element 19, the first lowband RF antenna element 38 is directly connected to the first highband RF antenna element 40. In one embodiment of the first RF antenna element 18 and the second RF antenna element 19, there is a separation 54 (FIG. 8) between the first lowband RF antenna element 38 and the first highband RF antenna element 40, such that the separation 54 (FIG. 8) is less than an antenna length 64 (FIG. 9B) of the first lowband RF antenna element 38. As such, in one embodiment of the first RF antenna element 18 and the second RF antenna element 19, the first lowband RF antenna element 38 is not directly connected to the first highband RF antenna element 40.

In one embodiment of the third RF antenna element 20 and the fourth RF antenna element 21, the second lowband RF antenna element 42 is proximal to the second highband RF antenna element 44. As such, in one embodiment of the third RF antenna element 20 and the fourth RF antenna element 21, the second lowband RF antenna element 42 overlaps the second highband RF antenna element 44. In one embodiment of the third RF antenna element 20 and the fourth RF antenna element 21, the second lowband RF antenna element 42 is directly connected to the second highband RF antenna element 44. In one embodiment of the third RF antenna element 20 and the fourth RF antenna element 21, there is a separation 54 (FIG. 8) between the second lowband RF antenna element 42 and the second highband RF antenna element 44, such that the separation 54 (FIG. 8) is less than an antenna length 64 (FIG. 9B) of the second lowband RF antenna element 42. As such, in one embodiment of the third RF antenna element 20 and the fourth RF antenna element 21, the second lowband RF antenna element 42 is not directly connected to the second highband RF antenna element 44.

In one embodiment of the first RF antenna transmit signal TXA1, a frequency range of the first RF antenna transmit signal TXA1 is between about 698 megahertz (MHz) and about 960 MHz. In one embodiment of the second RF antenna transmit signal TXA2, a frequency range of the second RF antenna transmit signal TXA2 is between about 1710 MHz and about 2700 MHz. In one embodiment of the second RF antenna transmit signal TXA2, the frequency range of the second RF antenna transmit signal TXA2 is between about 1710 MHz and about 2170 MHz. In one embodiment of the second RF antenna transmit signal TXA2, the frequency range of the second RF antenna transmit signal TXA2 is between about 2300 MHz and about 2170 MHz.

In one embodiment of the first RF antenna receive signal RXA1, a frequency range of the first RF antenna receive signal RXA1 is between about 698 MHz and about 960 MHz. In one embodiment of the second RF antenna receive signal RXA2, a frequency range of the second RF antenna receive signal RXA2 is between about 1710 MHz and about 2700 MHz. In one embodiment of the second RF antenna receive signal RXA2, the frequency range of the second RF antenna receive signal RXA2 is between about 1710 MHz and about 2170 MHz. In one embodiment of the second RF antenna receive signal RXA2, the frequency range of the second RF antenna receive signal RXA2 is between about 2300 MHz and about 2170 MHz.

In one embodiment of the RF communications circuitry 10, the RF communications circuitry 10 provides transmit uplink carrier aggregation (TXULCA) by simultaneously providing the first upstream RF transmit signal TXU1 and the second upstream RF transmit signal TXU2 to the RF front-end circuitry 14.

In one embodiment of the RF communications circuitry 10, the RF communications circuitry 10 supports receive downlink carrier aggregation (RXDLCA) by simultaneously receiving and processing the first RF antenna receive signal RXA1 and the second RF antenna receive signal RXA2.

Figure 3:
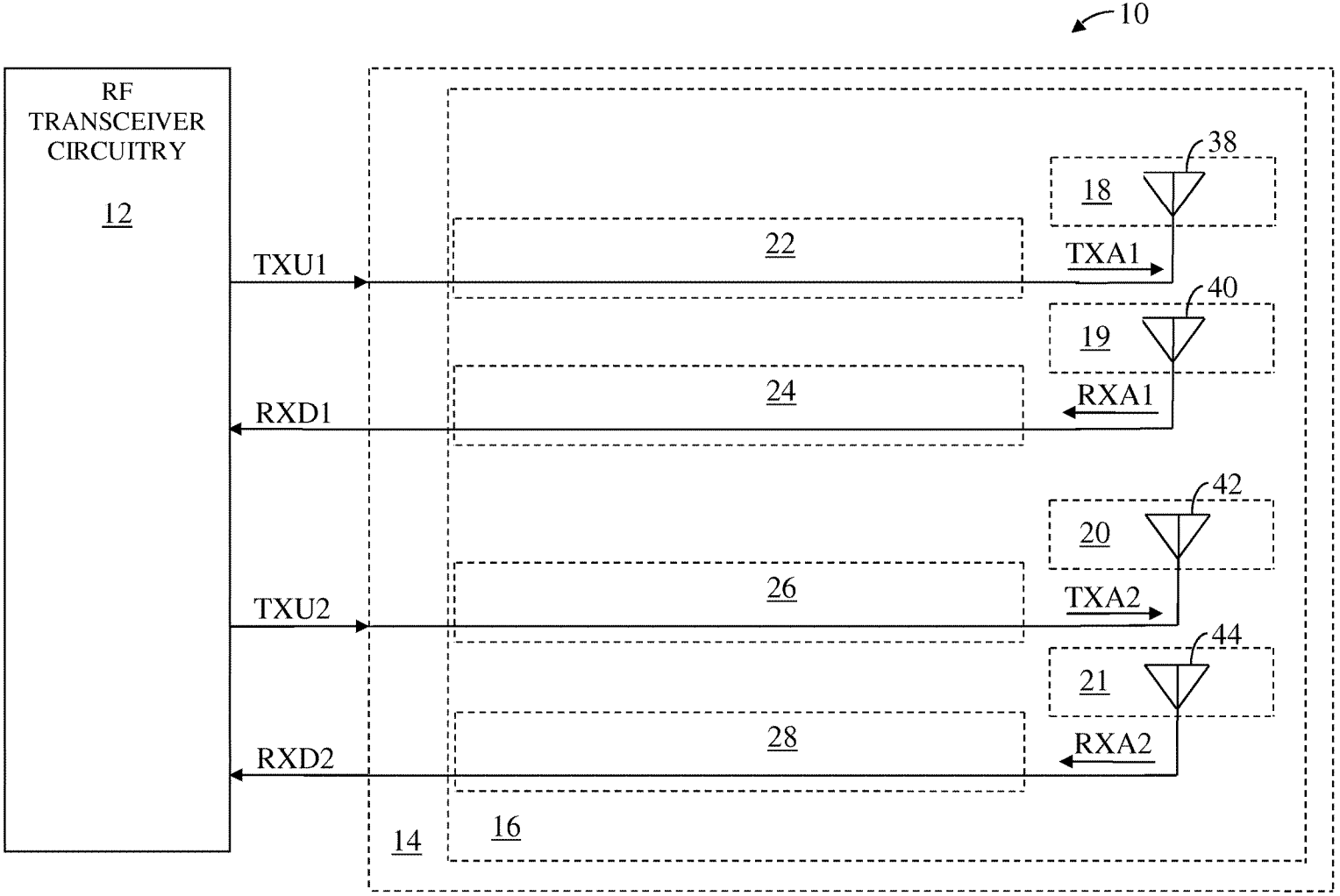
FIG. 3 shows RF communications circuitry according to an additional embodiment of the RF communications circuitry.

FIG. 3 shows RF communications circuitry 10 according to an additional embodiment of the RF communications circuitry 10. The RF communications circuitry 10 illustrated in FIG. 3 is similar to the RF communications circuitry 10 illustrated in FIG. 2, except in the RF communications circuitry 10 illustrated in FIG. 3, the first highband RF antenna element 40 receives and provides the first RF antenna receive signal RXA1 to the second RF transmission line 24, which forwards the first RF antenna receive signal RXA1 to provide the first downstream RF receive signal RXD1 to the RF transceiver circuitry 12. Additionally, the RF transceiver circuitry 12 provides the second upstream RF transmit signal TXU2 to the third RF transmission line 26, which forwards the second upstream RF transmit signal TXU2 to provide the second RF antenna transmit signal TXA2 to the second lowband RF antenna element 42, which transmits the second RF antenna transmit signal TXA2.

In general, the first RF antenna element 18 transmits the first RF antenna transmit signal TXA1. The third RF antenna element 20 transmits the second RF antenna transmit signal TXA2. The second RF antenna element 19 receives the first RF antenna receive signal RXA1. The fourth RF antenna element 21 receives the second RF antenna receive signal RXA2.

Figure 4:
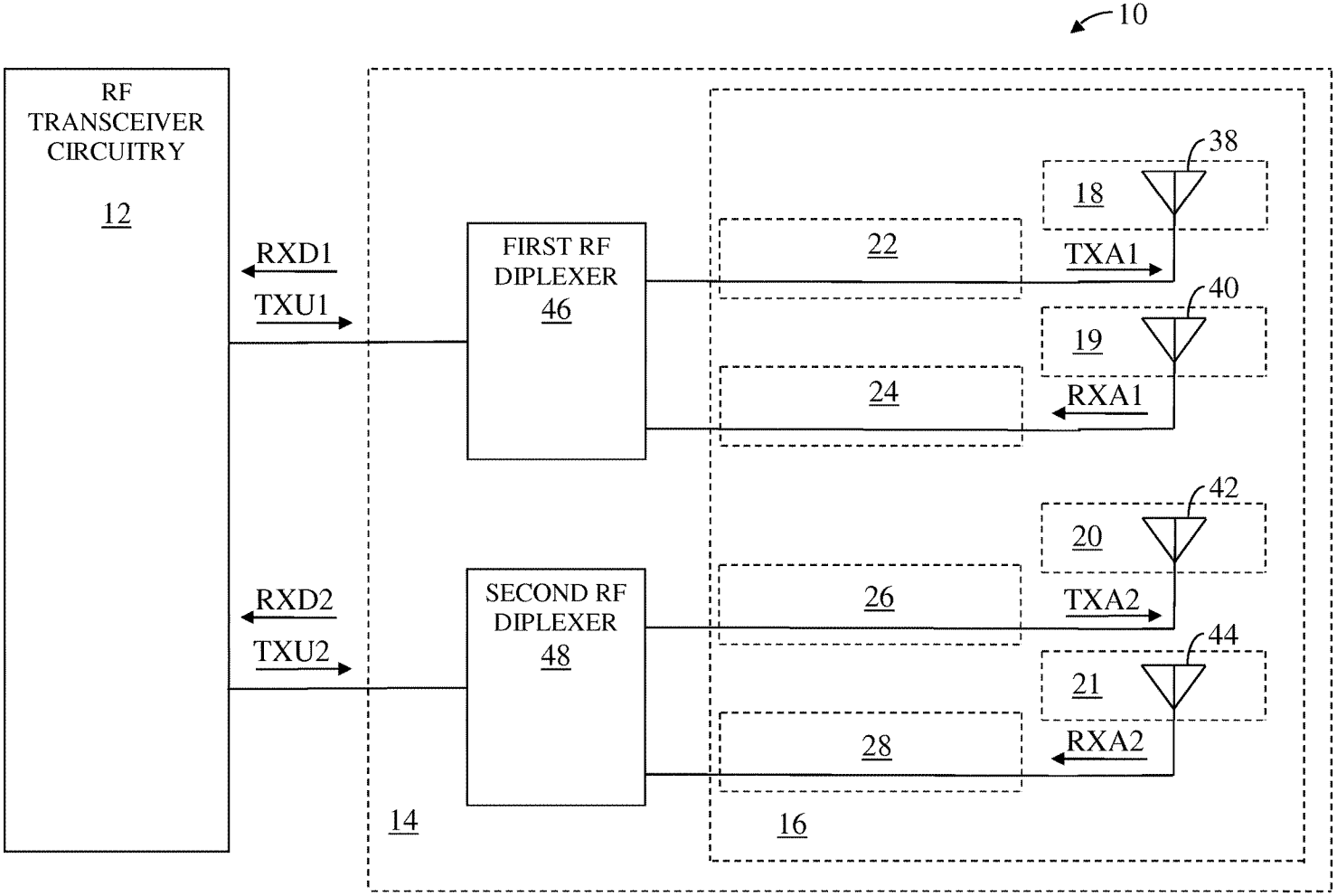
FIG. 4 shows RF communications circuitry according to another embodiment of the RF communications circuitry.

FIG. 4 shows RF communications circuitry 10 according to another embodiment of the RF communications circuitry 10. The RF communications circuitry 10 illustrated in FIG. 4 is similar to the RF communications circuitry 10 illustrated in FIG. 3, except in the RF communications circuitry 10 illustrated in FIG. 4, the RF front-end circuitry 14 further includes a first RF diplexer 46 and a second RF diplexer 48. The first RF diplexer 46 is coupled between the RF transceiver circuitry 12 and the RF antenna structure 16. The second RF diplexer 48 is coupled between the RF transceiver circuitry 12 and the RF antenna structure 16.

The first RF diplexer 46 receives and provides the first upstream RF transmit signal TXU1 and the first downstream RF receive signal RXD1, from and to, respectively, the RF transceiver circuitry 12 via a single signal path. The first RF diplexer 46 separates the first upstream RF transmit signal TXU1 and the first downstream RF receive signal RXD1 to provide and receive, respectively, the first RF antenna transmit signal TXA1 and the first RF antenna receive signal RXA1, respectively.

The second RF diplexer 48 receives and provides the second upstream RF transmit signal TXU2 and the second downstream RF receive signal RXD2, from and to, respectively, the RF transceiver circuitry 12 via a single signal path. The second RF diplexer 48 separates the second upstream RF transmit signal TXU2 and the second downstream RF receive signal RXD2 to provide and receive, respectively, the second RF antenna transmit signal TXA2 and the second RF antenna receive signal RXA2, respectively.

The first RF diplexer 46 provides the first RF antenna transmit signal TXA1 to the first RF antenna element 18 via the first RF transmission line 22. The first RF diplexer 46 receives the first RF antenna receive signal RXA1 from the second RF antenna element 19 via the second RF transmission line 24. The second RF diplexer 48 provides the second RF antenna transmit signal TXA2 to the third RF antenna element 20 via the third RF transmission line 26. The second RF diplexer 48 receives the second RF antenna receive signal RXA2 from the fourth RF antenna element 21 via the fourth RF transmission line 28.

Figure 5:
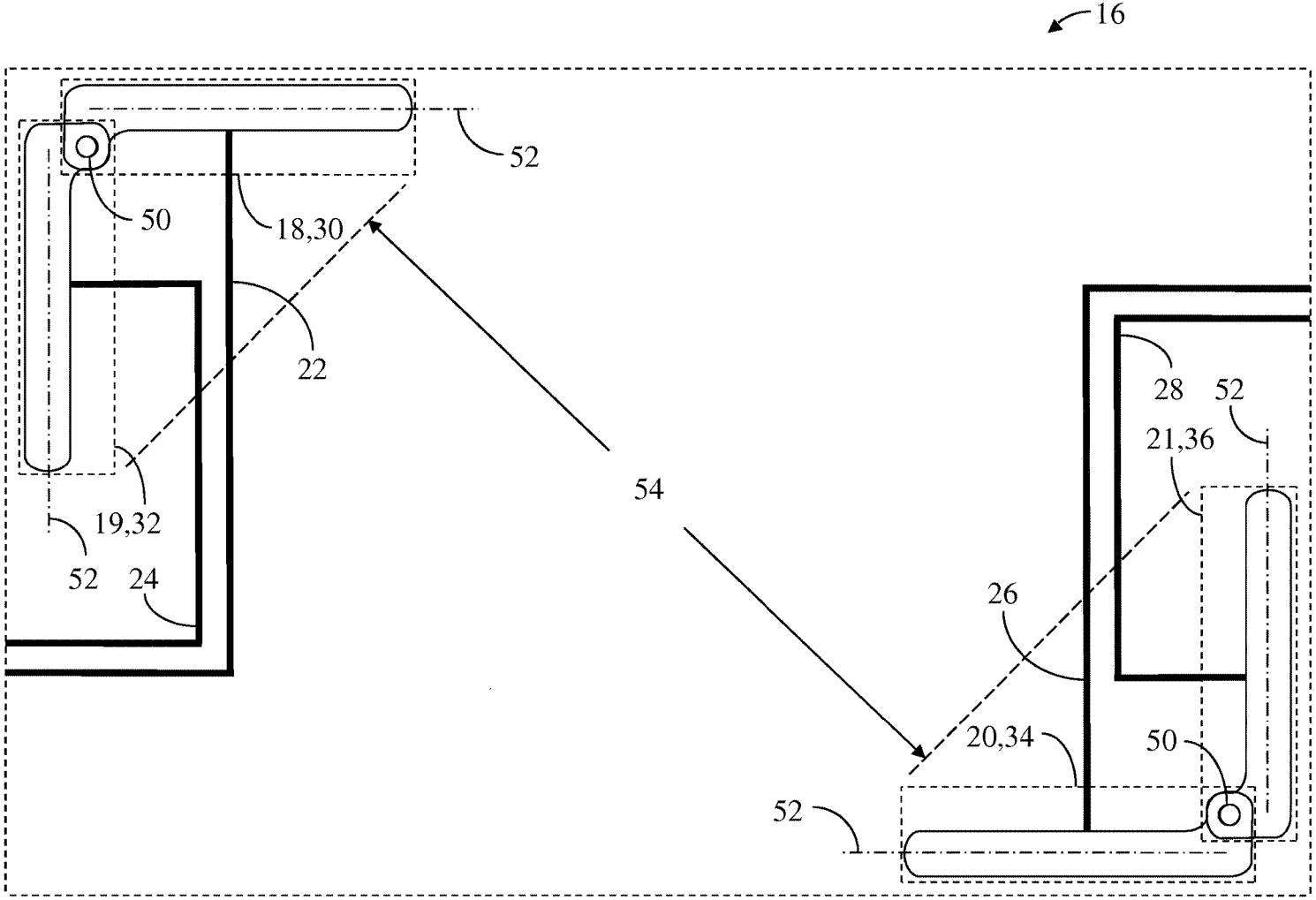
FIG. 5 shows details of an RF antenna structure illustrated in FIG. 1 according to one embodiment of the RF antenna structure.

FIG. 5 shows details of the RF antenna structure 16 illustrated in FIG. 1 according to one embodiment of the RF antenna structure 16. FIG. 5 shows a top view of the RF antenna structure 16. As such, the first RF antenna element 18 is the first RF transmit antenna element 30, the second RF antenna element 19 is the second RF transmit antenna element 32, the third RF antenna element 20 is the first RF receive antenna element 34, and the fourth RF antenna element 21 is the second RF receive antenna element 36.

In one embodiment of the RF antenna structure 16, the first RF antenna element 18, the second RF antenna element 19, the third RF antenna element 20, and the fourth RF antenna element 21 are substantially coplanar. The first RF antenna element 18 is directly connected to the first RF transmission line 22. The second RF antenna element 19 is directly connected to the second RF transmission line 24. The third RF antenna element 20 is directly connected to the third RF transmission line 26. The fourth RF antenna element 21 is directly connected to the fourth RF transmission line 28.

The first RF antenna element 18 overlaps the second RF antenna element 19. The third RF antenna element 20 overlaps the fourth RF antenna element 21. There is a separation 54 between all of the first RF antenna element 18 and the second RF antenna element 19 and all of the third RF antenna element 20 and the fourth RF antenna element 21. In one embodiment of the RF antenna structure 16, the separation 54 is greater than about the antenna length 64 (FIG. 9B) of the first RF antenna element 18 and less than about ten times the antenna length 64 (FIG. 9B) of the first RF antenna element 18. In an alternate embodiment of the RF antenna structure 16, the separation 54 is greater than about two times the antenna length 64 (FIG. 9B) of the first RF antenna element 18 and less than about twenty times the antenna length 64 (FIG. 9B) of the first RF antenna element 18.

The first RF antenna element 18 and the second RF antenna element 19 share a common grounding via hole 50. As such, the first RF antenna element 18 is directly connected to the second RF antenna element 19. In an alternate embodiment (not shown) of the first RF antenna element 18 and the second RF antenna element 19, the first RF antenna element 18 and the second RF antenna element 19 do not share a common grounding via hole 50. The third RF antenna element 20 and the fourth RF antenna element 21 share a common grounding via hole 50. As such, the third RF antenna element 20 is directly connected to the fourth RF antenna element 21. In an alternate embodiment (not shown) of the third RF antenna element 20 and the fourth RF antenna element 21, the third RF antenna element 20 and the fourth RF antenna element 21 do not share a common grounding via hole 50.

The first RF antenna element 18 has a primary axis 52. The second RF antenna element 19 has a primary axis 52. The third RF antenna element 20 has a primary axis 52. The fourth RF antenna element 21 has a primary axis 52. The primary axis 52 of the first RF antenna element 18 is about perpendicular to the primary axis 52 of the second RF antenna element 19. The primary axis 52 of the first RF antenna element 18 is about perpendicular to the primary axis 52 of the fourth RF antenna element 21. The primary axis 52 of the first RF antenna element 18 is about parallel to the primary axis 52 of the third RF antenna element 20. The primary axis 52 of the third RF antenna element 20 is about perpendicular to the primary axis 52 of the fourth RF antenna element 21.

Figure 6:
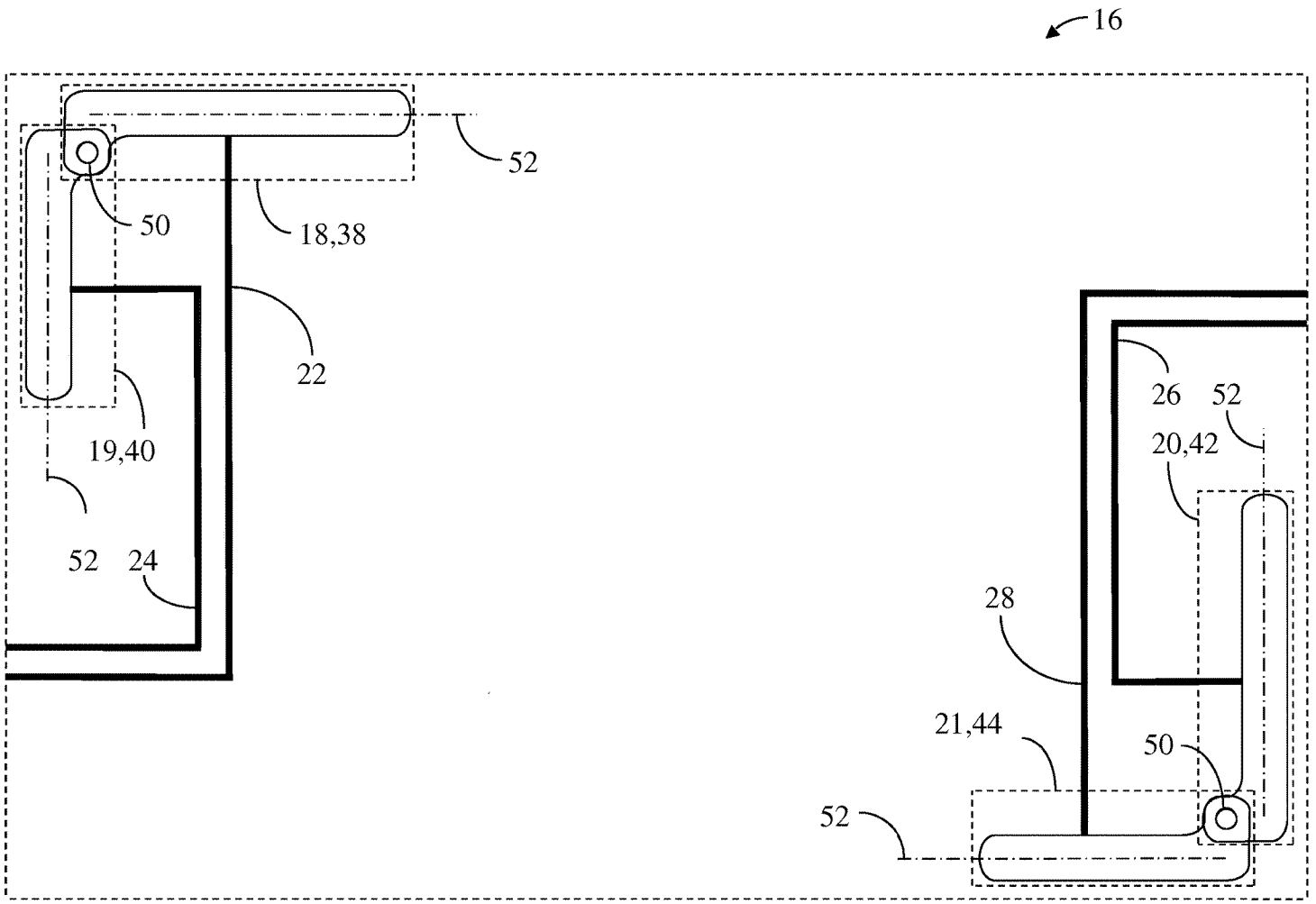
FIG. 6 shows details of the RF antenna structure illustrated in FIG. 2 according to one embodiment of the RF antenna structure.

FIG. 6 shows details of the RF antenna structure 16 illustrated in FIG. 2 according to one embodiment of the RF antenna structure 16. FIG. 6 shows a top view of the RF antenna structure 16. The RF antenna structure 16 illustrated in FIG. 6 is similar to the RF antenna structure 16 illustrated in FIG. 5, except in the RF antenna structure 16 illustrated in FIG. 6, the first RF antenna element 18 is the first lowband RF antenna element 38, the second RF antenna element 19 is the first highband RF antenna element 40, the third RF antenna element 20 is the second lowband RF antenna element 42, and the fourth RF antenna element 21 is the second highband RF antenna element 44.

The first RF antenna element 18 overlaps the second RF antenna element 19. The third RF antenna element 20 overlaps the fourth RF antenna element 21. The antenna length 64 (FIG. 9B) of the first RF antenna element 18 is greater than the antenna length 64 (FIG. 9B) of the second RF antenna element 19. The antenna length 64 (FIG. 9B) of the third RF antenna element 20 is greater than the antenna length 64 (FIG. 9B) of the fourth RF antenna element 21.

The primary axis 52 of the first RF antenna element 18 is about perpendicular to the primary axis 52 of the second RF antenna element 19. The primary axis 52 of the first RF antenna element 18 is about perpendicular to the primary axis 52 of the third RF antenna element 20. The primary axis 52 of the first RF antenna element 18 is about parallel to the primary axis 52 of the primary axis 52 of the fourth RF antenna element 21. The primary axis 52 of the third RF antenna element 20 is about perpendicular to the primary axis 52 of the fourth RF antenna element 21.

Figure 7:
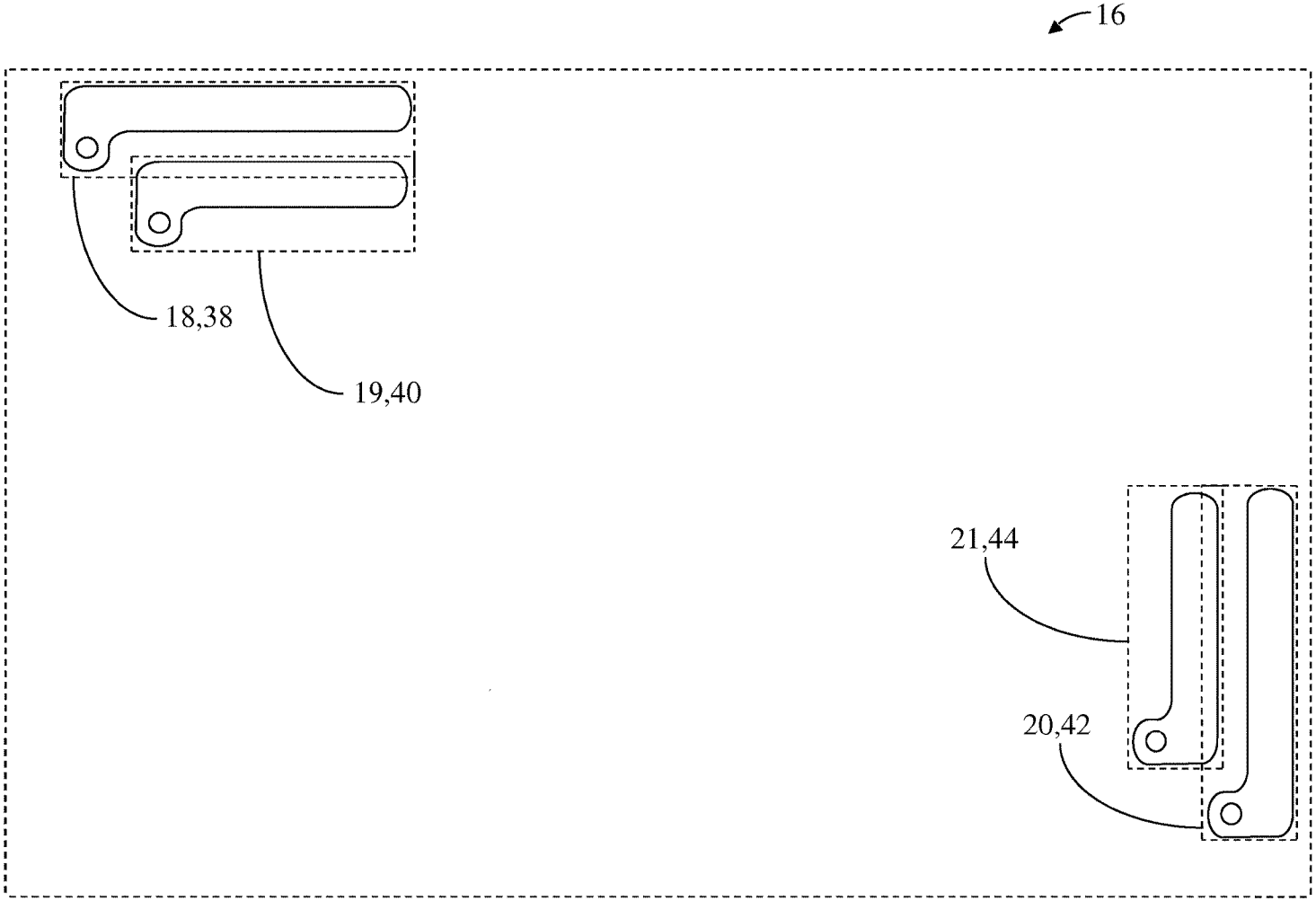
FIG. 7 shows details of the RF antenna structure illustrated in FIG. 3 according to one embodiment of the RF antenna structure.

FIG. 7 shows details of the RF antenna structure 16 illustrated in FIG. 3 according to one embodiment of the RF antenna structure 16. FIG. 7 shows a top view of the RF antenna structure 16. The RF antenna structure 16 illustrated in FIG. 7 is similar to the RF antenna structure 16 illustrated in FIG. 6, except the second RF antenna element 19 and the fourth RF antenna element 21 are in different locations. Also, the first RF transmission line 22, the second RF transmission line 24, the third RF transmission line 26, and the fourth RF transmission line 28 are omitted.

The first RF antenna element 18 overlaps the second RF antenna element 19. The third RF antenna element 20 overlaps the fourth RF antenna element 21. The antenna length 64 (FIG. 9B) of the first RF antenna element 18 is greater than the antenna length 64 (FIG. 9B) of the second RF antenna element 19. The antenna length 64 (FIG. 9B) of the third RF antenna element 20 is greater than the antenna length 64 (FIG. 9B) of the fourth RF antenna element 21.

The primary axis 52 of the first RF antenna element 18 is about parallel to the primary axis 52 of the second RF antenna element 19. The primary axis 52 of the first RF antenna element 18 is about perpendicular to the primary axis 52 of the third RF antenna element 20. The primary axis 52 of the first RF antenna element 18 is about perpendicular to the primary axis 52 of the fourth RF antenna element 21. The primary axis 52 of the third RF antenna element 20 is about parallel to the primary axis 52 of the fourth RF antenna element 21.

Figure 8:
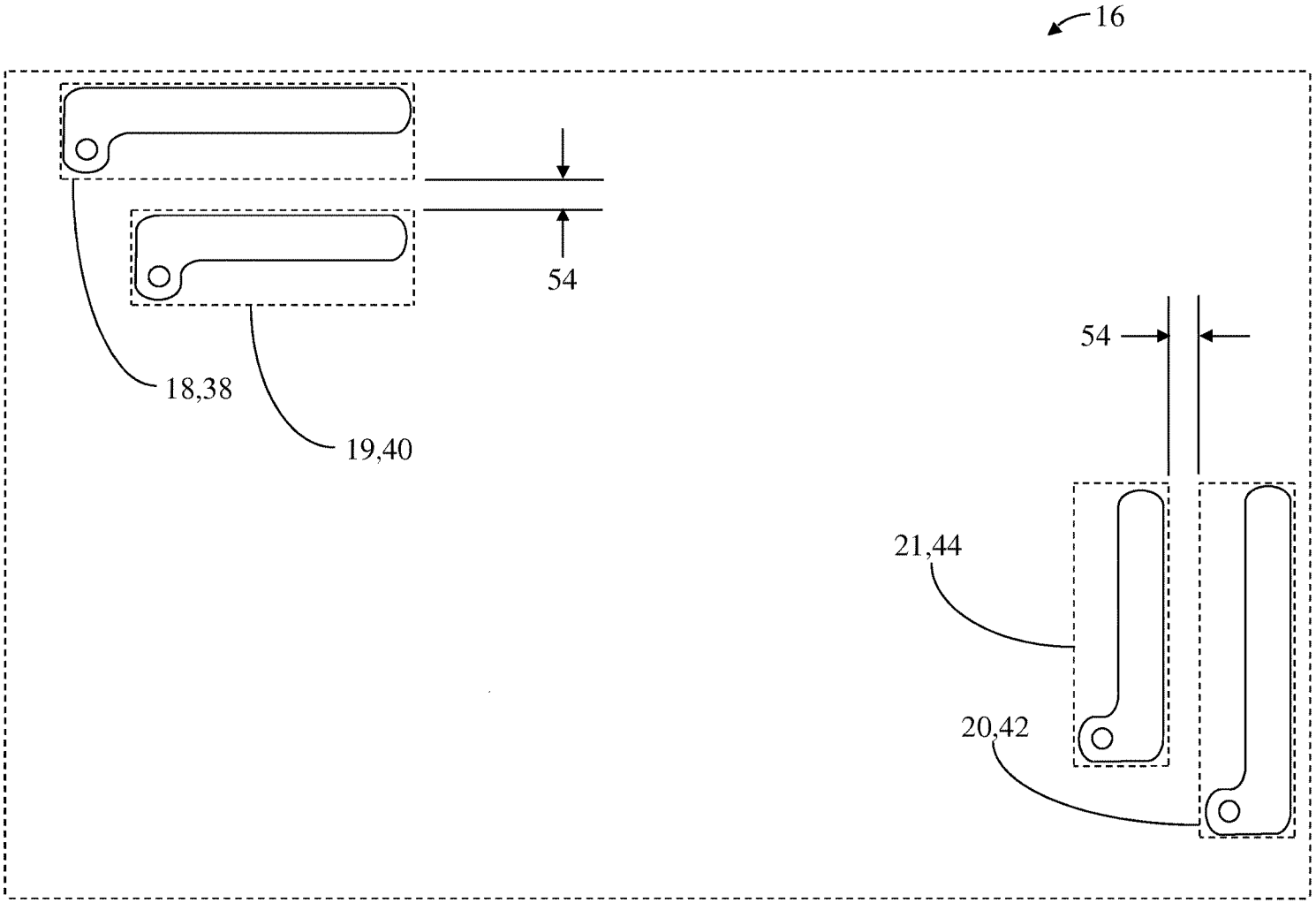
FIG. 8 shows details of the RF antenna structure illustrated in FIG. 3 according to an alternate embodiment of the RF antenna structure.

FIG. 8 shows details of the RF antenna structure 16 illustrated in FIG. 3 according to an alternate embodiment of the RF antenna structure 16. FIG. 8 shows a top view of the RF antenna structure 16. The RF antenna structure 16 illustrated in FIG. 8 is similar to the RF antenna structure 16 illustrated in FIG. 7.

The first RF antenna element 18 does not overlap the second RF antenna element 19. The third RF antenna element 20 does not overlap the fourth RF antenna element 21. The antenna length 64 (FIG. 9B) of the first RF antenna element 18 is greater than the antenna length 64 (FIG. 9B) of the second RF antenna element 19. The antenna length 64 (FIG. 9B) of the third RF antenna element 20 is greater than the antenna length 64 (FIG. 9B) of the fourth RF antenna element 21.

In one embodiment of the first RF antenna element 18 and the second RF antenna element 19, there is the separation 54 between the first RF antenna element 18 and the second RF antenna element 19. In one embodiment of the first RF antenna element 18 and the second RF antenna element 19, the separation 54 is less than the length 64 (FIG. 9B) of the first RF antenna element 18. As such, in one embodiment of the first RF antenna element 18 and the second RF antenna element 19, the first RF antenna element 18 is not directly connected to the second RF antenna element 19.

In one embodiment of the third RF antenna element 20 and the fourth RF antenna element 21, there is the separation 54 between the third RF antenna element 20 and the fourth RF antenna element 21. In one embodiment of the third RF antenna element 20 and the fourth RF antenna element 21, the separation 54 is less than the length 64 (FIG. 9B) of the third RF antenna element 20. As such, in one embodiment of the third RF antenna element 20 and the fourth RF antenna element 21, the third RF antenna element 20 is not directly connected to the fourth RF antenna element 21.

Figure 9A:
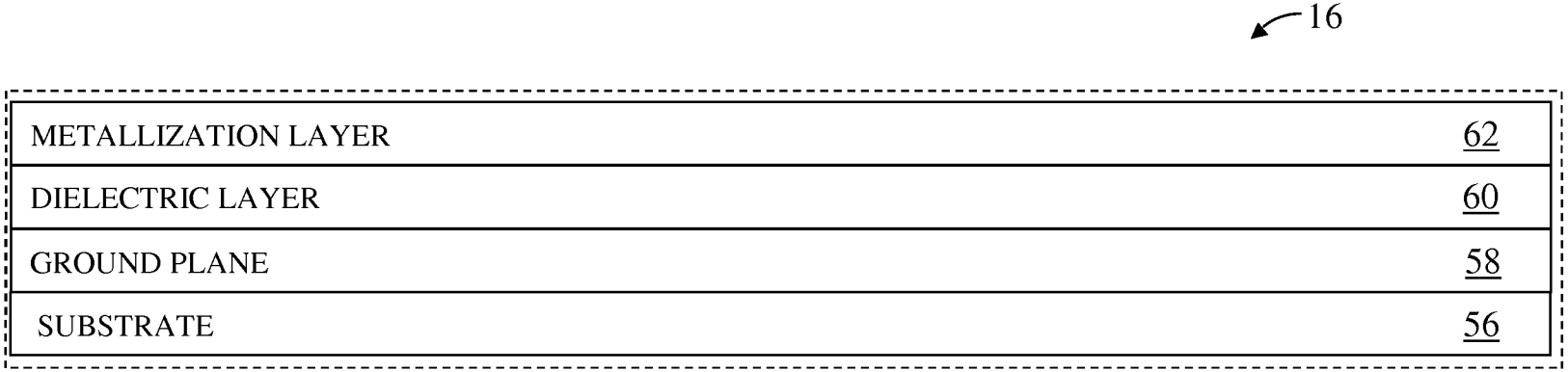
FIG. 9A shows details of the RF antenna structure illustrated in FIG. 5 according to one embodiment of the RF antenna structure.

FIG. 9A shows details of the RF antenna structure 16 illustrated in FIG. 5 according to one embodiment of the RF antenna structure 16. FIG. 9A shows a cross-section of the RF antenna structure 16. The RF antenna structure 16 has a substrate 56, a ground plane 58 over the substrate 56, a dielectric layer 60 over the ground plane 58, and a metallization layer 62 over the dielectric layer 60.

In one embodiment of the RF antenna structure 16, the metallization layer 62 substantially provides the first RF antenna element 18, the second RF antenna element 19, the third RF antenna element 20, and the fourth RF antenna element 21. In one embodiment of the RF antenna structure 16, the ground plane 58, the dielectric layer 60, and the metallization layer 62 are used to provide microstrip RF transmission lines. As such, the ground plane 58, the dielectric layer 60, and the metallization layer 62 may be used to provide any or all of the first RF transmission line 22, the second RF transmission line 24, the third RF transmission line 26, and the fourth RF transmission line 28. In an alternate embodiment of the RF antenna structure 16, the ground plane 58, the dielectric layer 60, or both are omitted.

Figure 9B:
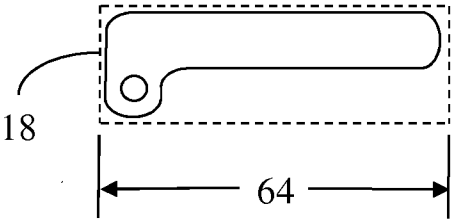
FIG. 9B shows details of a first RF antenna element illustrated in FIG. 6 according to one embodiment of the first RF antenna element.

FIG. 9B shows details of the first RF antenna element 18 illustrated in FIG. 6 according to one embodiment of the first RF antenna element 18. The first RF antenna element 18 has the antenna length 64.

None of the embodiments of the present disclosure are intended to limit the scope of any other embodiment of the present disclosure. Any or all of any embodiment of the present disclosure may be combined with any or all of any other embodiment of the present disclosure to create new embodiments of the present disclosure.

Those skilled in the art will recognize improvements and modifications to the embodiments of the present disclosure. All such improvements and modifications are considered within the scope of the concepts disclosed herein and the claims that follow.

What is claimed is:

1. An apparatus comprising:

a first RF antenna element and a second RF antenna element, wherein:

a length of the first RF antenna element is greater than a length of the second RF antenna element;

the first RF antenna element is proximal to the second RF antenna element;

the first RF antenna element is a first lowband RF antenna element; and the second RF antenna element is a highband RF antenna element;

a first RF transmission line and a second RF transmission line, wherein the first RF transmission line is connected to the first RF antenna element and the second RF transmission line is connected to the second RF antenna element;

a first RF diplexer coupling RF transceiver circuitry to the first RF transmission line and the second RF transmission line via a single signal path; and a third RF antenna element and a fourth RF antenna element, wherein:

the third RF antenna element is proximal to the fourth RF antenna element;

a primary axis of the first RF antenna element is perpendicular to a primary axis of the third RF antenna element;

the third RF antenna element is a second lowband RF antenna element; and a separation between all of the first RF antenna element and the second RF antenna element and all of the third RF antenna element and the fourth RF antenna element is greater than two times the length of the first RF antenna element.

2. The apparatus of claim 1 wherein the first RF antenna element overlaps the second RF antenna element.

3. The apparatus of claim 2 wherein the first RF antenna element is directly connected to the second RF antenna element.

4. The apparatus of claim 1 wherein the first RF antenna element is not directly connected to the second RF antenna element.

5. The apparatus of claim 1 wherein a separation between the first RF antenna element and the second RF antenna element is less than the length of the first RF antenna element.

6. The apparatus of claim 1 wherein the separation between all of the first RF antenna element and the second RF antenna element and all of the third RF antenna element and the fourth RF antenna element is greater than the length of the first RF antenna element and less than ten times the length of the first RF antenna element.

7. The apparatus of claim 1 wherein the separation between all of the first RF antenna element and the second RF antenna element and all of the third RF antenna element and the fourth RF antenna element is less than twenty times the length of the first RF antenna element.

8. The apparatus of claim 1 wherein the first RF antenna element, the second RF antenna element, the third RF antenna element, and the fourth RF antenna element are substantially coplanar.

9. The apparatus of claim 8 further comprising a substrate and a metallization layer, which is over the substrate and substantially provides the first RF antenna element, the second RF antenna element, the third RF antenna element, and the fourth RF antenna element.

10. The apparatus of claim 1 wherein the primary axis of the first RF antenna element is perpendicular to a primary axis of the second RF antenna element.

11. The apparatus of claim 10 wherein the first RF antenna element is a first RF transmit antenna element, which is a primary transmit antenna element, and the second RF antenna element is a second RF transmit antenna element, which is a diversity transmit antenna element.

12. The apparatus of claim 11 wherein the first RF antenna element is configured to transmit a first RF antenna transmit signal and the second RF antenna element is configured to transmit a second RF antenna transmit signal.

13. The apparatus of claim 1 wherein the primary axis of the third RF antenna element is perpendicular to a primary axis of the fourth RF antenna element.

14. The apparatus of claim 13 wherein the third RF antenna element is a first RF receive antenna element, which is a primary receive antenna element, and the fourth RF antenna element is a second RF receive antenna element, which is a diversity receive antenna element.

15. The apparatus of claim 14 wherein the third RF antenna element is configured to receive a first RF antenna receive signal and the fourth RF antenna element is configured to receive a second RF antenna receive signal.

16. The apparatus of claim 1 wherein the first RF antenna element is configured to transmit a first RF antenna transmit signal and the second RF antenna element is configured to receive a first RF antenna receive signal.

17. The apparatus of claim 16 wherein the first RF diplexer is configured to provide the first RF antenna transmit signal to the first RF antenna element and receive the first RF antenna receive signal from the second RF antenna element using the single signal path.

18. The apparatus of claim 1 wherein the primary axis of the first RF antenna element is perpendicular to a primary axis of the second RF antenna element.

19. The apparatus of claim 1 wherein the primary axis of the first RF antenna element is parallel to a primary axis of the second RF antenna element.

20. The apparatus of claim 1 wherein the third RF antenna element is configured to transmit an RF antenna transmit signal and the fourth RF antenna element is configured to receive an RF antenna receive signal.

21. The apparatus of claim 20 further comprising a second RF diplexer configured to provide the RF antenna transmit signal to the third RF antenna element and receive the RF antenna receive signal from the fourth RF antenna element.

22. The apparatus of claim 1 wherein the primary axis of the third RF antenna element is perpendicular to a primary axis of the fourth RF antenna element.

23. The apparatus of claim 1 wherein the primary axis of the third RF antenna element is parallel to a primary axis of the fourth RF antenna element.

* * * * *